US009605420B1

(12) United States Patent
Berger

(10) Patent No.: US 9,605,420 B1
(45) Date of Patent: Mar. 28, 2017

(54) UNIVERSAL, ATTACHABLE URINAL

(71) Applicant: Jason Gabriel Berger, Huntington Beach, CA (US)

(72) Inventor: Jason Gabriel Berger, Huntington Beach, CA (US)

( * ) Notice: Subject to any disclaimer, the term of this patent is extended or adjusted under 35 U.S.C. 154(b) by 0 days.

(21) Appl. No.: 15/161,254

(22) Filed: Jun. 13, 2016

Related U.S. Application Data

(60) Provisional application No. 62/291,506, filed on Feb. 4, 2016.

(51) Int. Cl.
*E03D 13/00* (2006.01)
*E03D 11/02* (2006.01)

(52) U.S. Cl.
CPC ..... *E03D 11/025* (2013.01); *E03D 13/00* (2013.01)

(58) Field of Classification Search
CPC ..... E03D 13/00
USPC ..... 4/300–442
See application file for complete search history.

(56) References Cited

U.S. PATENT DOCUMENTS 3,500,480 A * 3/1970 Michal, Jr. ..... E03D 11/025 138/128
3,742,522 A * 7/1973 Stevenson ..... E03D 13/00 4/307
3,822,419 A * 7/1974 Wilson, Sr. ..... E03D 13/00 4/144.4
4,137,579 A * 2/1979 Soler ..... E03D 13/00 4/144.3
4,145,768 A * 3/1979 Chevrette ..... E03D 13/00 4/144.1
4,282,611 A * 8/1981 O'Day ..... E03D 11/025 4/144.1
4,285,076 A * 8/1981 Dickstein ..... A61F 5/445 4/300.2
4,985,940 A * 1/1991 Jones ..... E03D 13/005 4/144.1
5,134,728 A * 8/1992 Sturm ..... E03D 11/12 4/307
5,153,947 A * 10/1992 Markles ..... E03D 13/00 285/56
5,285,532 A * 2/1994 Sealy ..... A47K 11/12 4/144.1
D346,016 S * 4/1994 McClelland ..... E03D 1/003 D23/302

(Continued)

OTHER PUBLICATIONS

Weeman Urinal, http://www.pottyscotty.com/mi-scotty-00032.html.
Dan Garvin, The Main Drain, http://www.themaindrain.com/.

*Primary Examiner* — Lori Baker

(57) ABSTRACT

A universal, attachable urinal. Urine is discharged into receptacle (2) that funnels to a waste-tube (11) that runs through a hollow arm (3) to a pre-existing waste receiver. The arm (3), mounted by the receptacle (2), pivots on a stationary leg (4) between an operational and a nonoperational position. The leg (4) is secured next to the toilet by foot (6*a*) and/or support arm (7), using the closet bolt (8), toilet seat bolt (9), or other nearby secured object. A water line runs from the toilet's water source to the receptacle (2) for rinsing it and the conjoined waste-tube (11). Embodiments vary between the waste-tube (11) leading to the toilet bowl (12) or sewer-line (39), the manual or semi-automatic upright return of the arm (3), methods for securing the leg (4), and methods for controlling water dispersion to and in the receptacle (2) for rinsing.

15 Claims, 14 Drawing Sheets

(56) References Cited

U.S. PATENT DOCUMENTS 5,299,328 A * 4/1994 Walega ..... E03D 1/003 4/341
5,390,374 A * 2/1995 Hubrig ..... E03D 1/003 4/300.1
5,499,405 A * 3/1996 Collins ..... E03D 11/025 4/306
5,575,020 A * 11/1996 Hubrig ..... E03D 1/003 4/342
5,655,230 A * 8/1997 Corbin ..... E03D 13/00 4/301
5,737,779 A * 4/1998 Haddock ..... E03D 13/00 4/301
5,787,517 A * 8/1998 Shadikhan ..... E03D 13/00 4/301
5,819,331 A * 10/1998 Miuccio ..... E03D 13/00 4/242.1
6,079,057 A * 6/2000 Mette ..... E03D 1/003 4/342
6,401,263 B2 * 6/2002 Chang ..... A47K 11/12 4/144.1
6,546,566 B1 * 4/2003 Geisel ..... A47K 11/12 4/144.1
6,684,414 B1 * 2/2004 Rehrig ..... A47K 11/12 4/144.1
7,228,572 B1 * 6/2007 Holden ..... A47K 11/12 4/144.1
7,331,068 B1 * 2/2008 Tichenor ..... E03D 5/10 4/301
7,496,974 B1 * 3/2009 Kang ..... E03D 11/125 4/301
7,882,968 B2 * 2/2011 Galt ..... A47K 13/06 211/106.01
8,166,579 B2 * 5/2012 Mehta ..... E03D 11/025 4/144.1
8,181,283 B2 * 5/2012 Burch ..... E03D 11/12 4/311
8,424,125 B2 * 4/2013 Anderson ..... A47K 11/12 4/144.1
9,194,115 B1 * 11/2015 Green ..... E03D 13/00
9,386,891 B1 * 7/2016 Guralnik ..... A47K 11/12
2012/0246816 A1 10/2012 Jung

* cited by examiner

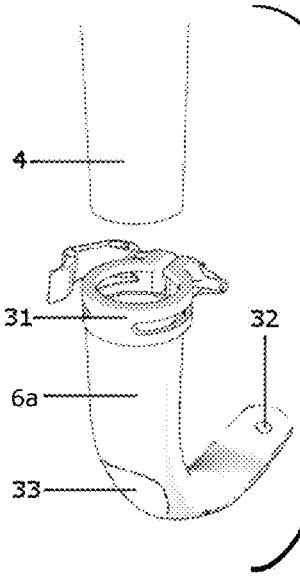
FIG 9
FIG 11
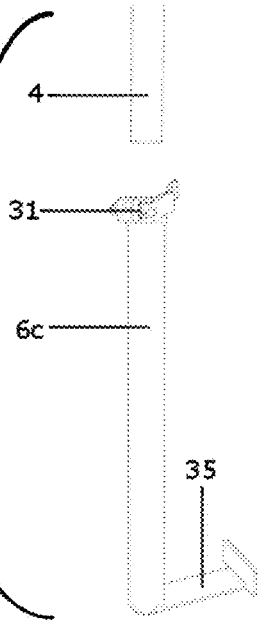
FIG 10
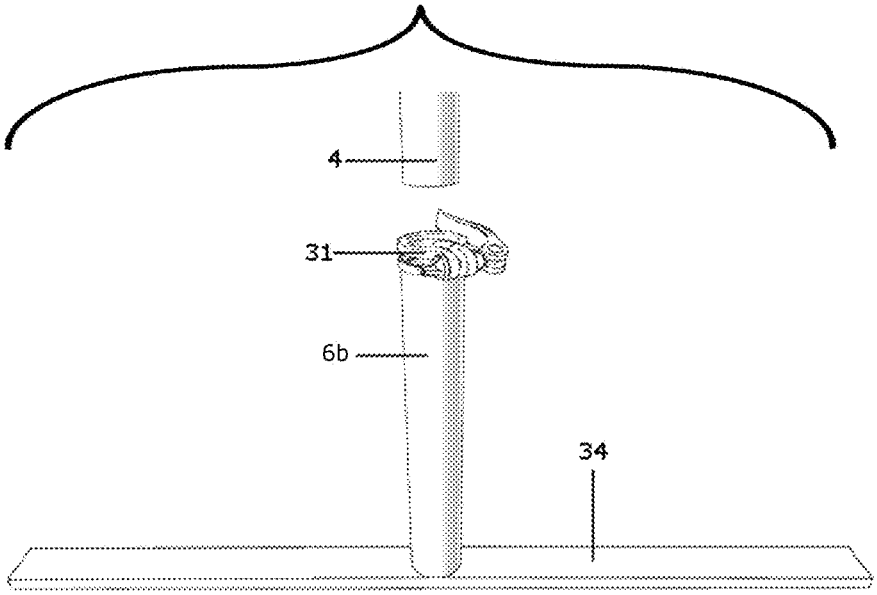

UNIVERSAL, ATTACHABLE URINAL

CROSS-REFERENCE TO RELATED APPLICATIONS

This application claims the benefit of Provisional patent application Ser. No. 62/291,506 filed Feb. 4, 2016, by the present inventor.

BACKGROUND

Prior Art

The following is a tabulation of some prior art that presently appears relevant:

| Pat. No. | Kind Code | Issue Date | Patentee |
|---|---|---|---|
| | | U.S. Patents | |
| 8,424,125 | B2 | Apr. 23, 2013 | A. M. Anderson |
| 4,137,579 | | Feb. 6, 1979 | P. S. Soler |
| 5,737,779 | | Apr. 14, 1998 | R. H. Haddock |
| 4,282,611 | | Aug. 11, 1981 | G. L. O'Day |
| 5,153,947 | | Oct. 13, 1992 | E. C. Markles |
| 5,390,374 | | Feb. 21, 1995 | S. E. Hubrig, et al. |
| 6,079,057 | | Jun. 27, 2000 | P. M. Mette |
| 5,655,230 | | Aug. 12, 1997 | J. H. Corbin |
| | | U.S. Pat. application Publications | |
| 2012/0246816 | A1 | Oct, 4, 2012 | S. Jung |
| | | Nonpatent Literature Documents | |
| Potty Scotty, Weeman Urinal, | | http://www.pottyscotty.com/mi-scotty-00032.html | |
| Garvin, The Main Drain, | | http://www.themaindrain.com/ | |
| Dan, | | | |

The conventional toilet is a heavy porcelain receptacle that is bolted to the floor and designed to receive liquid and solid waste. The conventional toilet is comprised of a bowl, pivotable seat and cover, water-tank, internal J-water trap connecting the bowl to a sewer drain, and flushing mechanism to flush water and waste from the bowl to the sewer drain. When the seat and cover is lifted to an upright position, the toilet is commonly used as a urinal for males while standing.

Using the toilet as a urinal in this manner causes a few disadvantages such as the mess left behind, the seat being left upright and unready for the next user who wishes to sit, and the over-consumption of water. The mess left behind can be attributed to the distance between the discharging member of the male and the toilet-bowl and the design of the toilet. This distance allows more opportunity for the urine stream to miss the interior of the toilet bowl. Furthermore, once missed, the urine stream splashes against the rim and sides of the bowl creating a greater mess. Even if the urine stream makes it into the toilet, there is no sure prevention against splashing out the water sitting inside the bowl, and even minute traces of the urine stream can splash out when hitting against the interior of the bowl. This remaining mess causes grief and frustration to and between all users of the facility, relieved only by the constant cleaning of the toilet and surrounding area or by requiring all male users to sit uncomfortably for urination.

Although leaving the seat in the upright position is not considered revolting by most people, the courtesy of lowering the seat can be much appreciated in all homes. For homes that require the courtesy, the only solution is to train (with much frustration) all males to put the seat down every time or to force the males to sit uncomfortably for urination.

Contemporarily, manufacturers have determined that to effectively flush solid waste through the J-water trap an amount of 1.25 gallons and 1.65 gallons of water are needed per flush, and have designed their toilets accordingly. Water consumption of a gallon and a half may not seem like much, but multiply it for every time the toilet is used during the day, for every person, and the volume of water devoted to human waste becomes staggering. There are several toilet kits on the market that include a second lever and flushing mechanism to flush with less water for liquid waste, about 1 gallon, as a less forceful flush is required. In regions where drought is severe, most do not flush for liquid waste, as it does not create much unpleasant odor or staining. With this in consideration, a dilution of water would help to counter whatever odor or stains may occur.

Although an area is designated for toilets in all bathrooms, most are limited to a small area and do not permit the space for a second waste receptacle intended for male urination. Furthermore, the water pressure found in residential areas does not permit the installation of urinals with a flushometer, which are commonly found in commercial restrooms.

A urine receptacle that attaches to the conventional toilet is the solution to the aforementioned problems; it can minimize the distance between the discharging member of the male and the receptacle, it can make the lifting of the seat unnecessary, it can decrease the consumption of water, and it would not occupy much space. Currently, the only attachable urinals on the market are simple, waterless apparatuses such as the WeeMan Urinal, which is a simple plastic pouch gripping the rim, and the Main Drain as seen on Kickstarter, which is a receptacle with a semi-flexible tube gripping the rim of the toilet. U.S. Pat. No. 8,424,125 B2 of A. M. Anderson describes a urinal of this type, which is a receptacle with an extendable arm gripping the toilet seat. These simple apparatuses must be rinsed manually and are intrusive for people sitting on the toilet, unless removed prior to sitting.

Multiple rinsable urinals attachable to a toilet have been proposed, none of them reaching the current mainstream market. This may be attributed to several factors such as inconvenient operation, faulty designs, or difficult or costly manufacturing or installation procedures. For example, U.S. Pat. No. 4,137,579 of P. S. Soler and U.S. Pat. No. 5,737,779 of R. H. Haddock must be hand-held during use, and thus are inconvenient to use.

Proposals of faulty designs include U.S. Pat. No. 4,282,611 of G. L. O'Day, which describes an attachable urinal that guides liquid waste into the bowl. In the nonoperational position, the attachable urinal is pivoted to the side where water or liquid waste remaining in the urinal can drip or pour out of the device and onto the floor, thus defeating its purpose. U.S. Pat. No. 5,153,947 of E. C. Markles describes an attachable urinal that pivots from brackets attached to the toilet seat bolts, There is nothing to prevent the urinal from pivoting below a 0° incline, which would allow remaining liquid waste or rinsing water to spill out. To prevent this, the user would be required to inconveniently hold the receptacle in place during use. Also, his only self-cleaning embodiment shows the receptacle and waste tubes are clean-rinsed only when the toilet is flushed, thus over-consuming water. Furthermore for this embodiment to work, the height of the receptacle cannot be adjusted to reach the heights of different users, as the low water-pressure of the toilet bowl's filling line would not be able to reach a receptacle much higher than the toilet tank, U.S. Pat. No. 5,390,374 of S. E. Hubrig, et al describes an attachable urinal with the receptacle attached to a flexible arm, a waste line leading from the receptacle, down the arm, into the toilet bowl, through the water trap, and leading to the sewer. The flexible member is unlikely dependable to release during operation, and the waste line obstructs solid waste in the water-trap. U.S. Pat. No. 6,079,057 of P. M. Mette describes a free-standing urinal with a reservoir to retain liquid waste when in operation. Since the waste reservoir allows the user of several of his embodiments to pivot below a 0° incline, the receptacle would have to be so designed that the underlip reaches upward to prevent the remaining liquid waste or rinsing water from spilling out. However, this design would make it difficult for a tall user to urinate into the receptacle. The installation of this free-standing urinal would require bolting to the walls or floors for security, thus defacing the walls or floors and lowering the value of the bathroom. Furthermore, the reservoir could cause problems such as mildew, foul odor, and difficulty in manipulating the urinal with a full reservoir.

Proposals that would require difficult or costly manufacturing or installation procedures include U.S. Pat. No. 5,655,230 of J. H. Corbin, which describes an auxiliary urinal retrofit, a self-supporting urinal with its own water-tank mounted to a base-plate that is secured by extending the base-plate under the toilet or attached to the wall. This design would require more space than what most bathrooms currently possess, and the installation would require the difficult removal of the toilet. U.S. Patent Application 2012/0246816 A1 of S. Jung describes a rotatable urinal that requires a new toilet with a design alteration of the conventional toilet to accept the attachable urinal, further increasing the cost to the consumer.

SUMMARY OF THE INVENTION

The objective of this invention is to provide a waste-line system that guides liquid waste from close proximity to a user's discharging member to a pre-existing waste-receiver without requiring the lifting of the toilet seat. This waste-line system is supported by a structure that securely attaches to a conventional toilet or other fastened object in the toilet's immediate vicinity, takes preventative measures to avoid water or waste spillage, and is unobtrusive for toilet-sitters when placed in the nonoperational position. Furthermore, this waste-line system has a controllable water-line system for dispersing water and clean-rinsing the waste-line system.

BRIEF DESCRIPTION OF THE DRAWINGS

FIG. 9 is a rear perspective view of a portion of the embodiment of FIGS. 1 and 2 with a foot and bottom portion of the leg.

FIG. 10 is a right perspective view of an alternate version of the foot of FIG. 9.

FIG. 11 is a rear perspective view of another alternate version of the foot of FIG. 9.

DETAILED DESCRIPTION

FIGS. 1-6, 8, 9—First Embodiment

Figure 1:
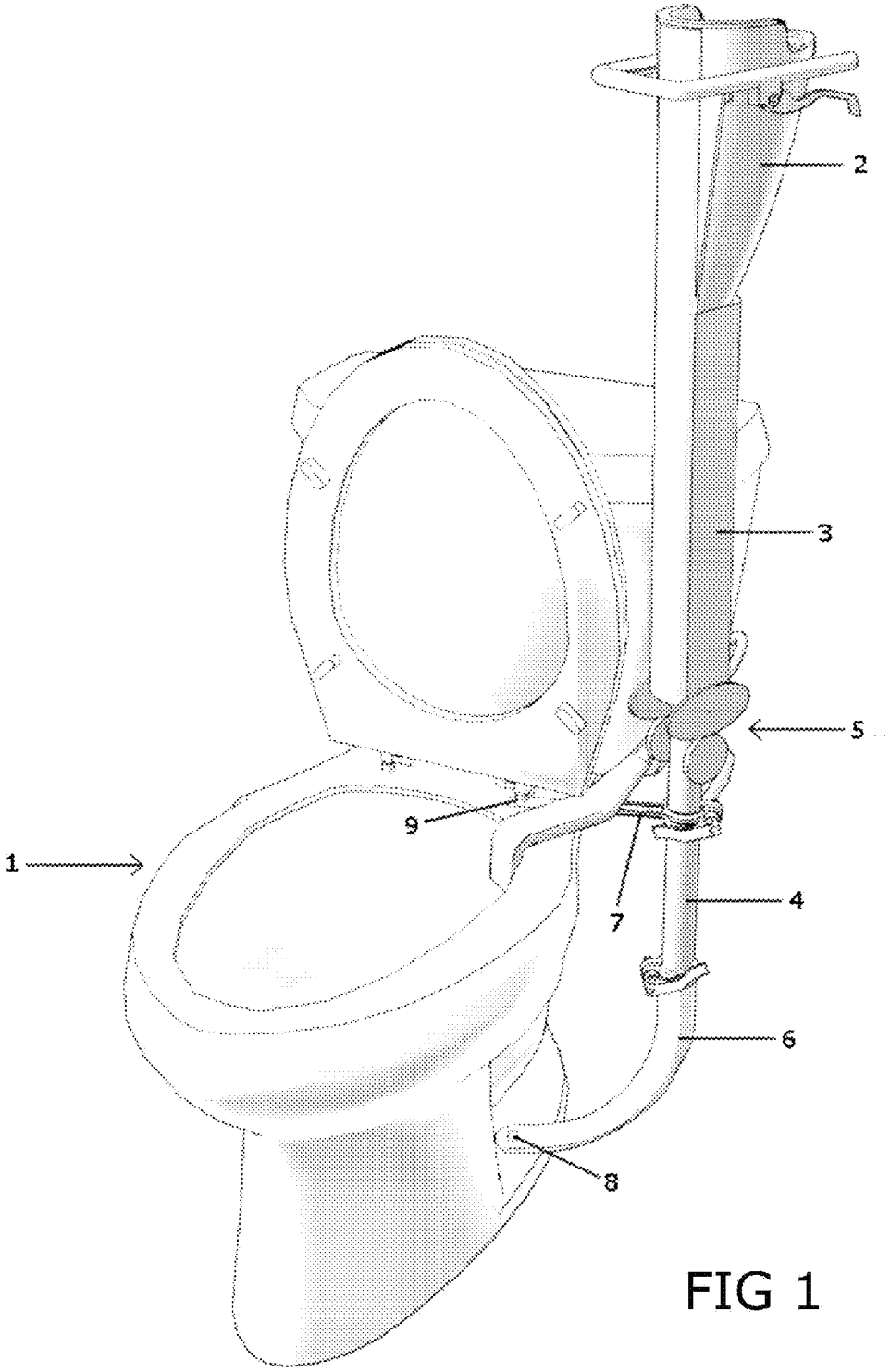
FIG. 1 is a front-right perspective view of an embodiment of an adjustable urinal, which is attached to a conventional toilet in the first, upright, non-operational position.

FIG. 1 shows an embodiment of an adjustable, attachable urinal as it would be mounted on a toilet 1 in the first, non-operational, upright position. The major structure of this embodiment and others later described consists of a receptacle 2 joined to a hollow, rigid arm 3, which is mounted at the top of a hollow, cylindrical leg 4 at a point of pivot 5. The leg 4 is held in place by a foot 6*a* and a support-arm 7, which are bolted to a closet bolt 8 and a toilet-seat bolt 9, respectively.

Figure 2:
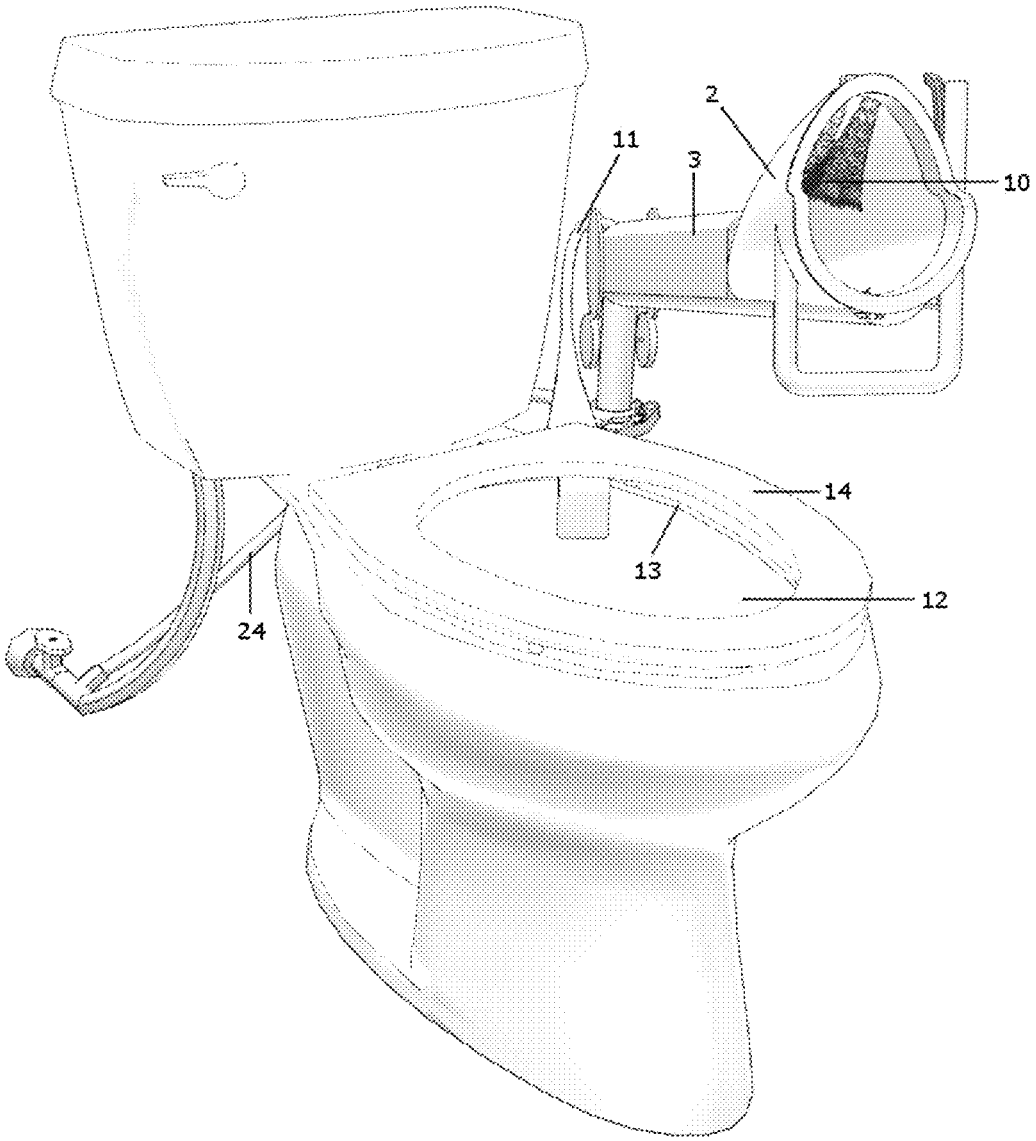
FIG. 2 is a front-left perspective view of the embodiment of FIG. 1, which is attached to a conventional toilet in the second, near-horizontal, operational position.

FIG. 2 shows the embodiment of FIG. 1 in the second, operational, near-horizontal position. In this position, a water-spray 10 is released inside the receptacle 2. The receptacle 2 connects to a waste tube 11 that leads through the hollow arm 3 and exits the arm 3 at the point of pivot 5. The waste tube 11 then turns toward the toilet 1, passes between the rim of the toilet bowl 13 and the toilet seat 14, and turns into the toilet bowl 12.

Figure 3:
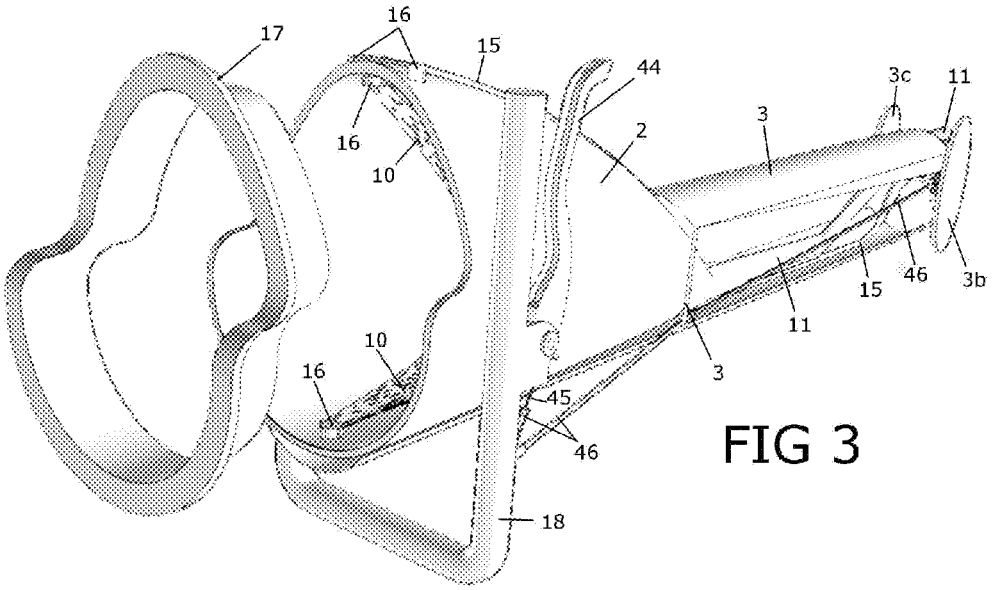
FIG. 3 is a front-right perspective view of a portion of the embodiment of FIG. 1 with a cone-like shaped receptacle and a section-cut of an arm for a view of the arm's interior.
Figure 4:
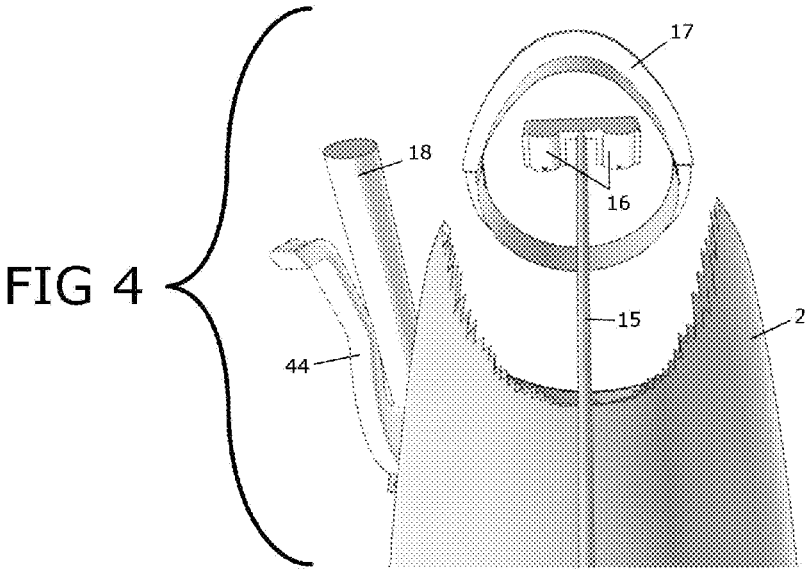
FIG. 4 is a top-rear perspective view of the receptacle portion of the embodiment of FIG. 1 with a section-cut of the receptacle.

FIGS. 3, 4, 5, 6, 8, and 9 show different portions of embodiment of FIG. 1. This embodiment includes a spring-powered mechanism for returning the arm 3 from the second position to the first position. FIGS. 3 and 4 feature the receptacle 2 and arm 3. FIG. 3 is from a right perspective view with a cross-section of the arm 3 and FIG. 4 is from a top-rear perspective view with a cross-section of the receptacle 2. Both FIGS. 3 and 4 show a water-inlet tube 15, which is led through the arm 3, along the receptacle 2 to water-sprayers 16 near the edge of the receptacle 2, a rim 17 at the edge of the receptacle 2, and a handle 18 joined to the receptacle 2. A lever 44 is mounted to the handle 18, which pulls on a wire 45 when pressed. The wire 45 and a wire-sleeve 46 leads through the arm 3 (the edge of the arm 3 is left out of the section-cut to demonstrate that the wire leads into the arm 3) to the point of pivot 5. As shown in FIG. 3, the waste tube 11 connects to the neck end of the receptacle 2 and runs through the hollow arm 3 alongside the water-inlet tube 15 and wire-sleeve 46. FIG. 3 demonstrates how the rim 17 and edge of the receptacle 2 is curved so that the lower portion is slightly more extruded than the top.

Figure 5:
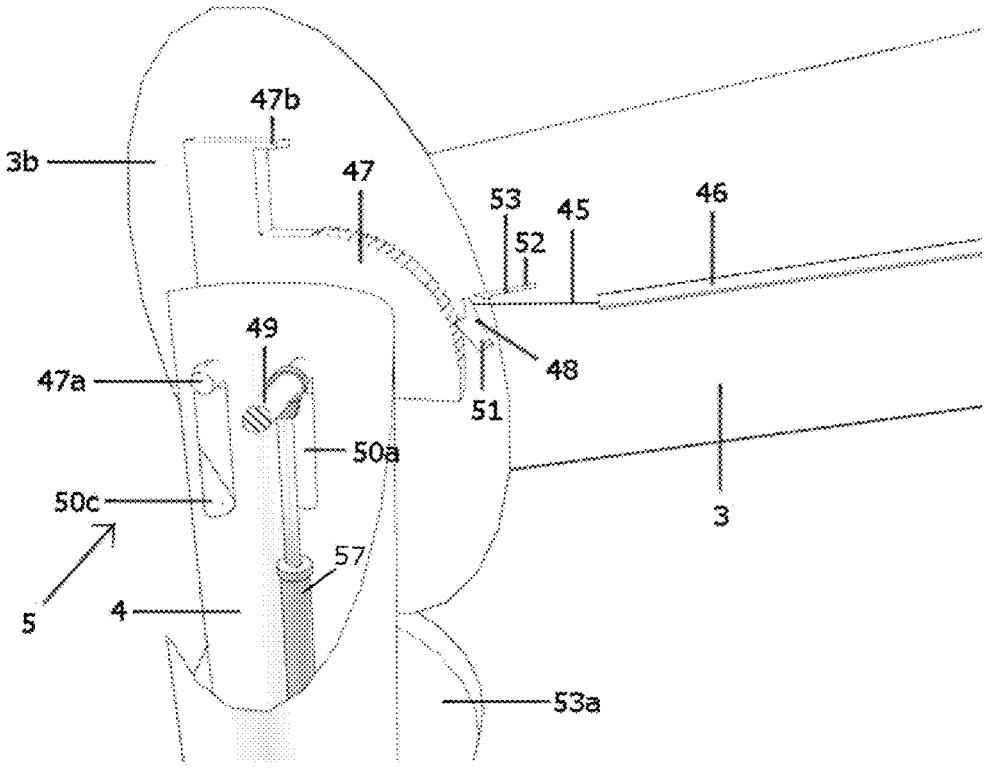
FIG. 5 is a left perspective view of the point of pivot portion of the embodiment of FIG. 1 with a section-cut of the arm and a leg.
Figure 6:
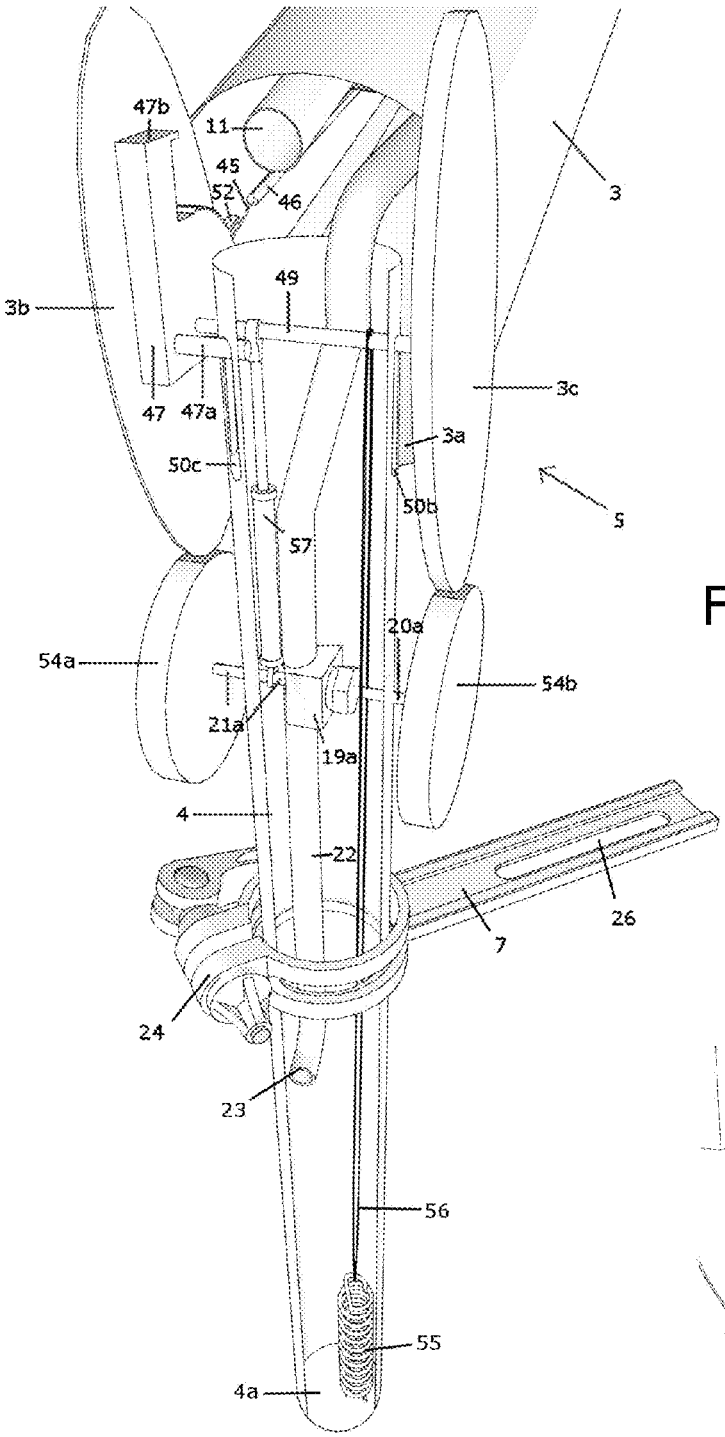
FIG. 6 is a rear perspective view of the leg and point of pivot portion of the embodiment of FIG. 1 with a section-cut of the leg for a view of the leg's interior.

FIG. 5 shows a left-perspective view of a cross-section of the arm 3 and leg 4, and FIG. 6 shows a rear perspective view of the bottom part of the arm 3 and a cross-section of the leg 4. Both FIGS. 5 and 6 show that a ratchet wheel 47 is held loosely in place by an axle 49, which is joined to the two sides of the arm 3 that runs through the leg 4 at elongated holes 50*a* and 50*b*. A peg 47*a* protruding from the ratchet wheel 47 runs through the leg 4 at elongated hole 50*c*. The wire 45 is connected to the pawl 48, which is held loosely in place by a rod 51 with a torsion spring (not shown) turning the pawl 48 toward the ratchet wheel 47, and where the rod 51 connects to the arm 3. A latch 52 is held in place by a rod 53 in the same fashion as the pawl 48 is held by the rod 51 with the rod 53 being connected to the arm 3 with a torsion spring (not shown) turning the latch 52 toward the pawl 48. The ratchet wheel 47 has a protrusion that extends vertically in the rear, which has a protrusion 47*b* that extends horizontally forward.

Furthermore, FIGS. 5 and 6 show that the sides at the end of the arm 3 at the point of pivot 5 is shaped elliptically 3*b* and 3*c*, the edges of which is resting on two wheels 54*a* and 54*b*. The valve stem 20*a* attaches to one of these wheels 54*b*. The other wheel 54*a* is loosely fitted to an axle 21*a*, which is joined to both the leg 4 and valve 19*a*. FIG. 6 shows a compression spring 55 in which one end attaches to the base of the leg 4*a* and the other end attaches to a wire 56, which leads up the leg 4, past the valve 19*a* and valve stem 20*a*, and fastens around the arm axle 49. A pneumatic tube 57 is mounted to the two axles 49 (loosely) and 21*a*.

FIG. 6 also shows a water-inlet tube 15 connected to the valve 19*a*. The bottom side of the valve 19*a* connects to another water-inlet tube 22. This inlet tube 22 has a threaded end 23 for receiving a braided compression tube 24 (as shown in FIG. 2).

Figure 8:
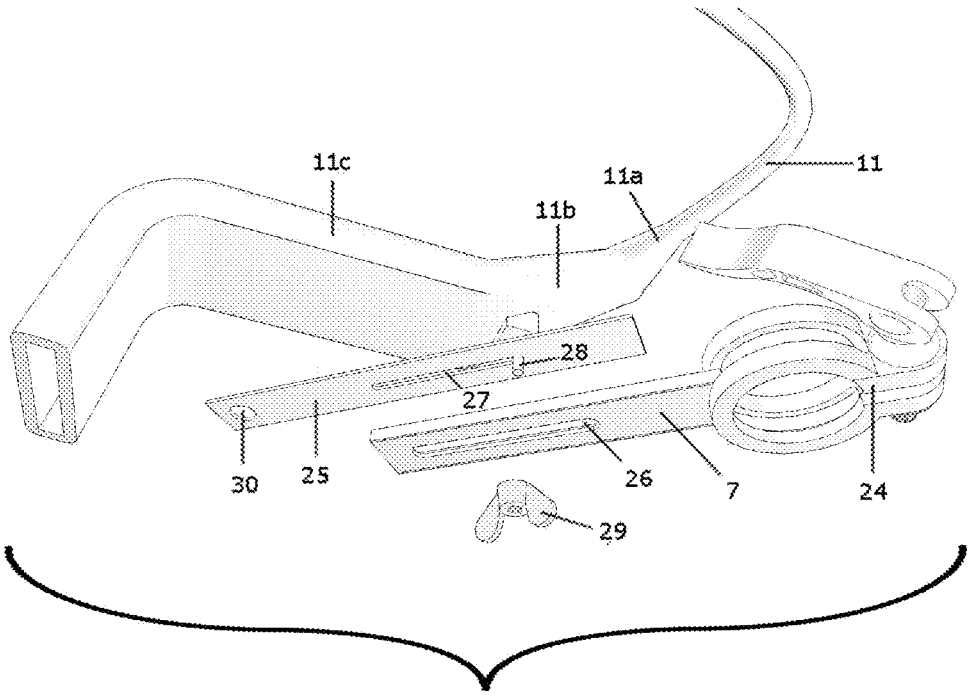
FIG. 8 is a right-bottom perspective view of a portion of the embodiment of FIGS. 1 and 2 with a support-arm and outlet end of a waste tube.

FIG. 8 shows an exploded, bottom-right view of the support-arm 7, previously shown in FIGS. 1, 2, and 6. The support-arm 7 is mounted to the leg 4 (FIG. 1) by a lever-tightening clamp 24 that is joined at one end of the support-arm 7. The support-arm 7 is shaped like a hollow bar with the middle part of the top-side removed. An extender-bar 25 slides into support arm 7 and a bolt 28 runs through both elongated holes 26 and 27, which tightens the two bars together by a wing-nut 29. The end of the extender-bar 25 on the opposite end of the clamp 24 has a hole 30 for fitting a contemporary toilet seat bolt 9.

Furthermore, FIG. 8 shows that in the area where the waste tube 11 is about to end, the tube alters its shape 11*b* from a cylindrical-like tube 11*a* to a horizontal, rectangular-like tube 11*c*, which leads between the toilet bowl rim 13 and toilet seat 14 (FIG. 2), which is then bent downward and placed into the toilet bowl 12 (FIG. 2). The bolt 28 holding the support-arm and extender-bar 25 together is affixed to the waste tube 11 between the shape alteration 11*b* and the rectangular tube 11*c*.

FIG. 9 shows a right perspective view of the foot 6*a* and bottom portion of the leg 4. The leg 4 is inserted at the top of the foot 6*a* by a lever-tightening clamp 31. The foot 6*a* is curved and has a hole 32 for inserting the closet bolt 8 (FIG. 1). A hole 33 in the foot 6*a* allows the leg 4 to slide through the bottom of the foot 6*a*.

Operation

FIGS. 1-6, 8, 9—First Embodiment

The embodiment of this adjustable, attachable urinal was designed to be installed on a variety of conventional toilets 1, on either side. Installation is as follows: the foot 6*a* (detailed in FIG. 9) is set to sit on the lower base of the toilet 1 with the foot's hole 32 on the pre-existing closet bolt 8. The hole 30 of the extender-bar 25 (detailed in FIG. 8) is placed on the toilet-seat bolt 9, and the clamp 24 of the support-arm 7 is placed loosely around the leg 4. The installer deposits leg 4 into the foot 6*a* and decides on the height of the overall urinal, including whether it should be lowered to slip through the hole 33 at the bottom of the foot 6*a*. The installer then tightens the clamp 31 of the foot 6*a*, decides whether the urinal should be placed further back or to the side by rotating the urinal, and then tightens the closet-bolt 8 to the foot 6*a*. The installer then slides the support-arm 7 to a height so that it is flush with the extender-bar 25. The installer then manipulates the end of the tube 11 so that the bolt 28 affixed to the tube 11 at the shape alteration 11*b* passes through both elongated holes of the support-arm 26 and the extender-bar 27. The installer then tightens the wing-nut 29 onto the bolt 28, tightens the toilet seat bolt 9, and tightens the clamp 24 onto the leg 4. To conclude, the installer fits a compression tube 24 from the pre-existing water outlet to the threads 23 of the water-inlet tube 22. Should the owner ever decide to alter the overall height of the urinal, he would simply have to release the lever-clamp 24, raise or lower the leg 4 to the desired height and retighten the lever-clamp 24.

Once installed, there are two positions for the adjustable, attachable urinal. The first position is an upright, non-operational position as shown in FIG. 1, and the second position is a near-horizontal, operational position as shown in FIG. 2. In the first position, the arm 3 is upright, the valve 19 is closed, and no water flows into the receptacle 2. As the operator maneuvers the arm 3 by pulling the handle 18 downward into the second position, the elliptical wheels 3*b* and 3*c* of the arm 3 turn and causes two events: the two wheels 54*a* and 54*b* to turn, and the arm 3 and all attached to rise.

As FIG. 6 illustrates, while one wheel 54*b* regulates water flow, the other wheel 54*a* and corresponding axle 21*a* provides balance to the arm 3 and pivoting motion. The wheel 54*b* is joined to the valve stem 20 so that as the wheel 54*b* turns, so does the valve stem 20, thus opening the valve 19 and releasing water from the water-inlet tube 22 into the water-inlet tube 15 to the water sprayers 16, and into the receptacle 2 to rinse the interior (detailed in FIGS. 3 and 5). From the receptacle 2, the water and/or waste is then funneled into the waste-tube 11, and as FIG. 8 illustrates, the water is then funneled from the waste tube's cylindrical portion ha to the tube's alteration 11*b*, and then to the rectangular tube 11*c*, where it escapes into the toilet bowl 12. The rectangular tube 11*c* is designed to be thin in order to reach the toilet bowl 12 with the toilet seat 14 down by passing between the toilet rim 13 and the toilet seat 14 without the seat resting on and pinching the tube 11*c*.

Referring to FIGS. 5 and 6, as the elliptical wheels 3*b* and 3*c* turn, the distance between the centers and thus the axles of the ellipses 49 and the wheels 20*a*/21*a* increase. The only allowance of this distance increase is for the axle of the ellipses 49 to rise in the elongated holes 50*a* and 50*b* of the leg 4. As the axle 49 rises, so does the wire 56 wrapped around it, which in effect pulls on and stretches the compression spring 55. If there is no resistance, the spring would pull the axle 49, wire 56, and arm 3 downward, causing the arm 3 to turn back to its upward position. However, the pawl 48 and ratchet wheel 47 offers such resistance. The ratchet wheel 47 is designed so that as it rises along with the arm 3 the wheel does not turn with the arm 3: the ratchet wheel 47 is loosely fitted on the axle 49 and the peg 47*a* is inserted an elongated hole 50*c* of the leg 4, thus preventing the ratchet wheel 47 from rotating. Also, as the arm 3 turns, the pawl 48 runs along the circumference of the ratchet wheel 47 to be caught in the lower teeth and catching the arm 3 along with it.

As the arm 3 turns to the second position, the operator may decide on the angle of the arm, and therefore the ultimate height of the receptacle 2 by deciding which tooth of the ratchet wheel 47 to catch on the pawl 48 (detailed in FIGS. 5 and 6). However, the minimal height of the receptacle 2 is determined by two properties: the length of the elongated holes 50*a* and 50*b*, which would prevent any further distance between the axles 49 and 20*a*/21*a*, thus preventing any further turning of the ellipses 3*b* and 3*c* and arm 3, and the length of the extrusion of the arm 3*a*, which would collide with the leg 4. The angle determining this minimal height is not to exceed below a 5° incline to prevent water spillage.

As illustrated in FIG. 2 and detailed in the exploded views of FIGS. 3 and 4, the rim 17 prevents water from spilling straight down from the water-sprayers 16 and offers some protection from water spraying or spilling backward. The rim's 17 curvature offers an operator a view and an access for manipulation.

To return this embodiment to the first position, the operator simply squeezes the lever 44 (detailed in FIG. 3), The lever 44 pulls the wire 45, which pulls one end of the pawl 48 (detailed in FIGS. 5 and 6) in order to rotate away from the ratchet wheel 47. This allows the compression spring 55 to compress since the previously mentioned resistance is now eliminated, now causing the arm 3 to return to its first position. To keep the pawl 48 away from the ratchet wheel 47 during the position change, the pawl 48 hooks onto the latch 52 when it is rotated from the lever 44 squeeze. Once the arm 3 is back in the first position, the latch 52 is pushed on the opposite side by the ratchet wheel's forward protrusion 47*b*, causing the latch 52 to rotate and release the pawl 48 while ready to be caught on the ratchet wheel 47, once again. The wire 45 is covered by a sleeve 46 to guide the wire 45 and prevent the sleeve 46 from catching. The pneumatic tube 57 mounted to the two axles 49 (loosely) and 21*a* slows the distance between them, thus hindering acceleration and the rapid or jerky movement of the arm 3 in its rotation, and consequently acts as a cushioning for said arm, preventing any potential damage to or shifting of the urinal.

Detailed Description

FIGS. 8,9, 12-15—Second Embodiment

Figure 12:
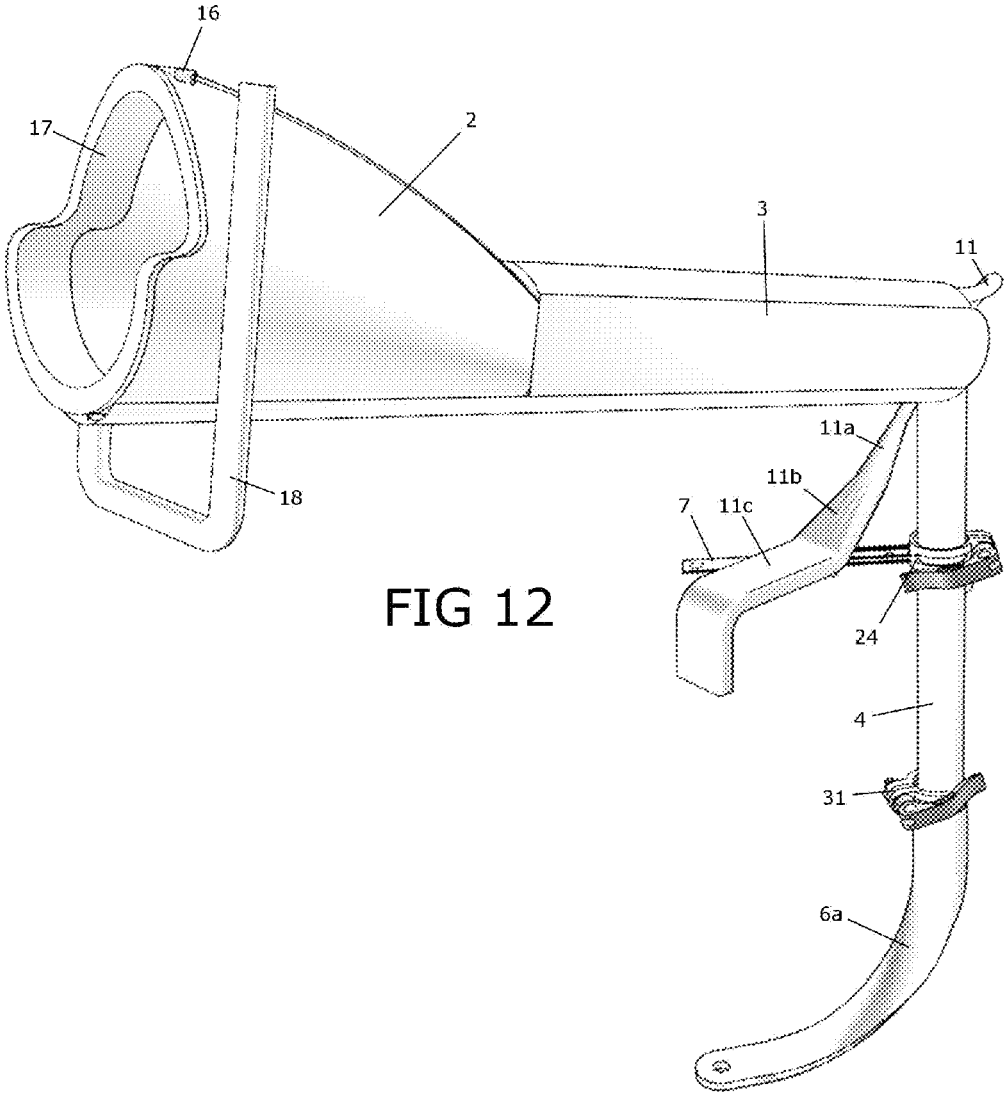
FIG. 12 is a front-right perspective of another embodiment of an attachable, adjustable urinal.

FIGS. 8, 9, 12, 13, 14, and 15 show another embodiment of the attachment urinal. FIG. 12 shows a full, right perspective view of this embodiment. The second embodiment is similar to the first as the second replicates the designs of the parts of FIGS. 8 and 9, differing by altering the design of the water-inlet system somewhat and excluding the spring-return mechanism, which comprises of: the elliptical wheels 3*b* and 3*c*, the wheels 54*a* and 54*b* and their respective axles 49, 21*a* and 21*b*, the spring 55 and attached wire 56, the pneumatic tube 57, and the elongated holes of the leg 4-50*a*, 50*b*, and 50*c*.

Figure 13:
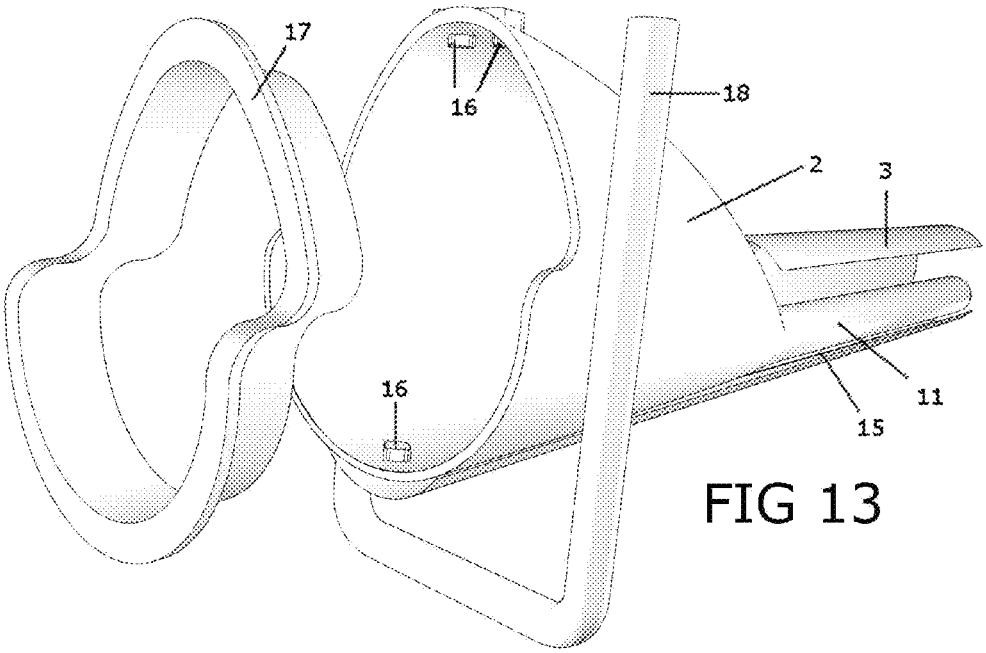
FIG. 13 is a front-right perspective view of a portion of the embodiment of FIG. 12 with a cone-like shaped receptacle and arm, the arm has a section-cut for a view of the arm's interior.
Figure 14:
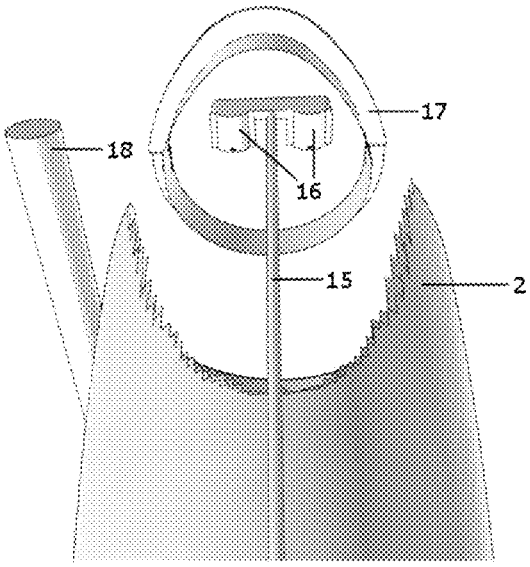
FIG. 14 is a top-rear perspective view of a portion of the embodiment of FIG. 12 with a section-cut of the receptacle.

As seen in both FIGS. 13 and 14 (FIG. 13 is a front-right perspective view, FIG. 14 is a top-rear perspective view) and compared to FIGS. 3 and 4, the lever 44 is eliminated. In FIG. 13 (when compared to FIG. 3), the wire 45 and wire-sleeve 46 is eliminated so that only the waste-tube 11 and water-inlet 15 travel inside the hollow of the arm 3.

Figure 15:
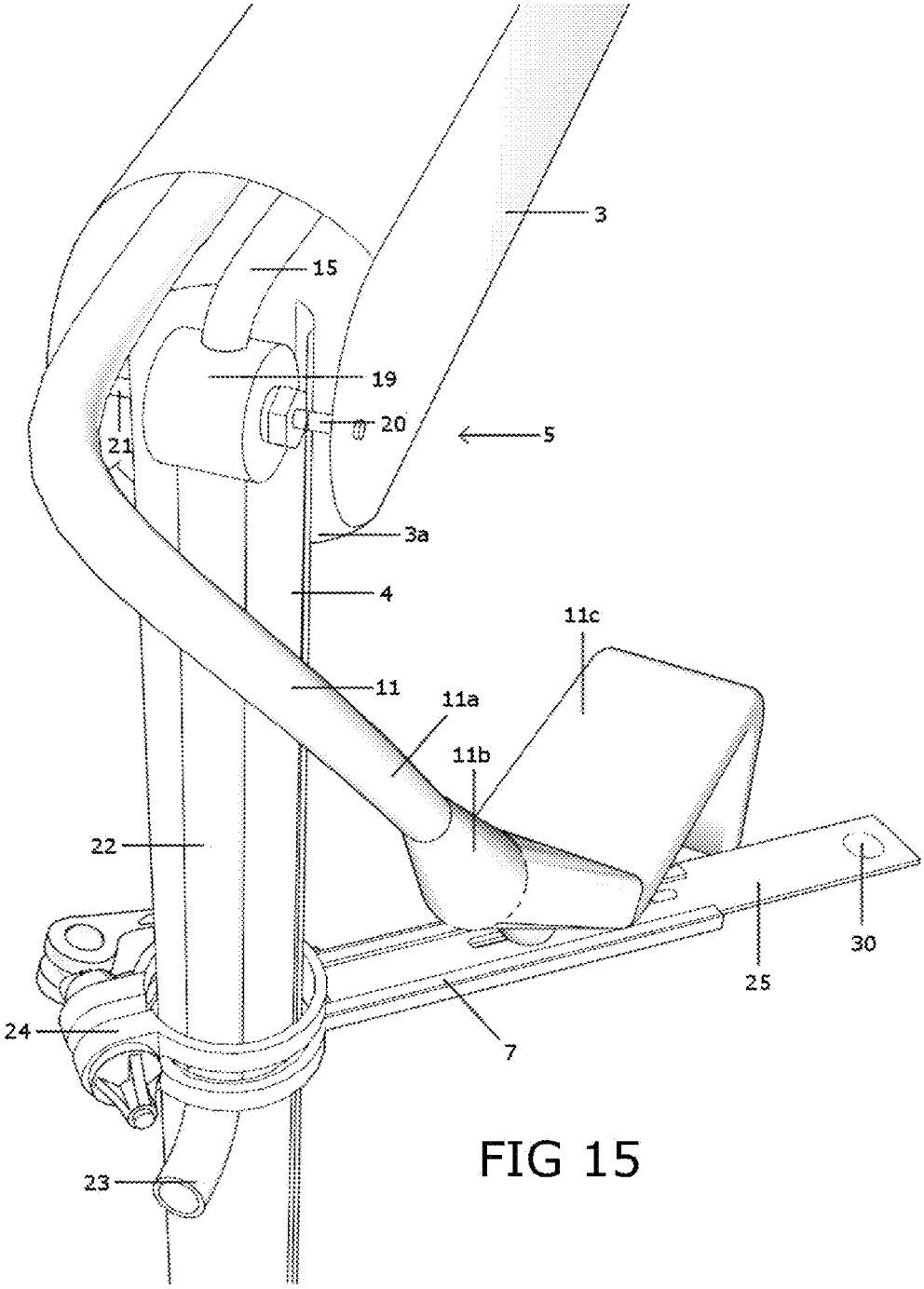
FIG. 15 is a rear perspective view of a portion of the embodiment of FIG. 12 with the point of pivot where the bottom part of the arm meets the top portion of the leg, which has a section-cut for a view of the leg's interior.

FIG. 15 is a rear perspective view featuring the point of pivot 5, which is a lower portion of the arm 3 and a cross-section of the top portion of the leg 4. Compared to FIG. 6, the parts of the spring-return mechanism (mentioned previously) have all been eliminated. Instead, the arm 3 is joined to a valve stem 20 and loosely attached to an axle 21. The valve stem 20 goes through a hole in the top of the leg 4 and enters a valve 19. The axle 21 is joined to the leg 4 on the opposite end. The valve 19 is held in place by the leg 4. The water-inlet tube 22 connects to the valve 19 from the bottom and the water-inlet tube 15 connects to the valve 19 from the top and continues through the arm 3 as it does in the first embodiment.

Operation

Figure 16:
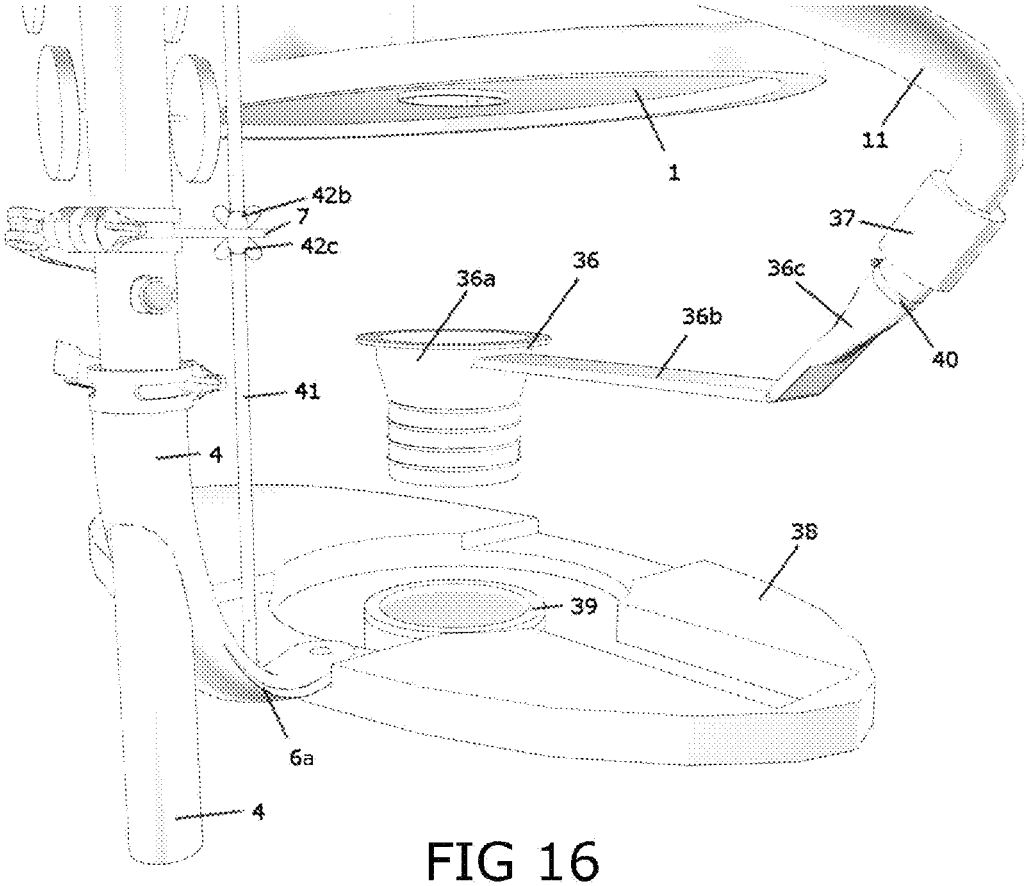
FIG. 16 is a rear-right perspective view of the bottom of another embodiment of the urinal that features an alternate waste-expulsion design using a 3-way toilet-seal and toilet-base, and the bottom of the toilet, which is raised for demonstration.
Figure 17:
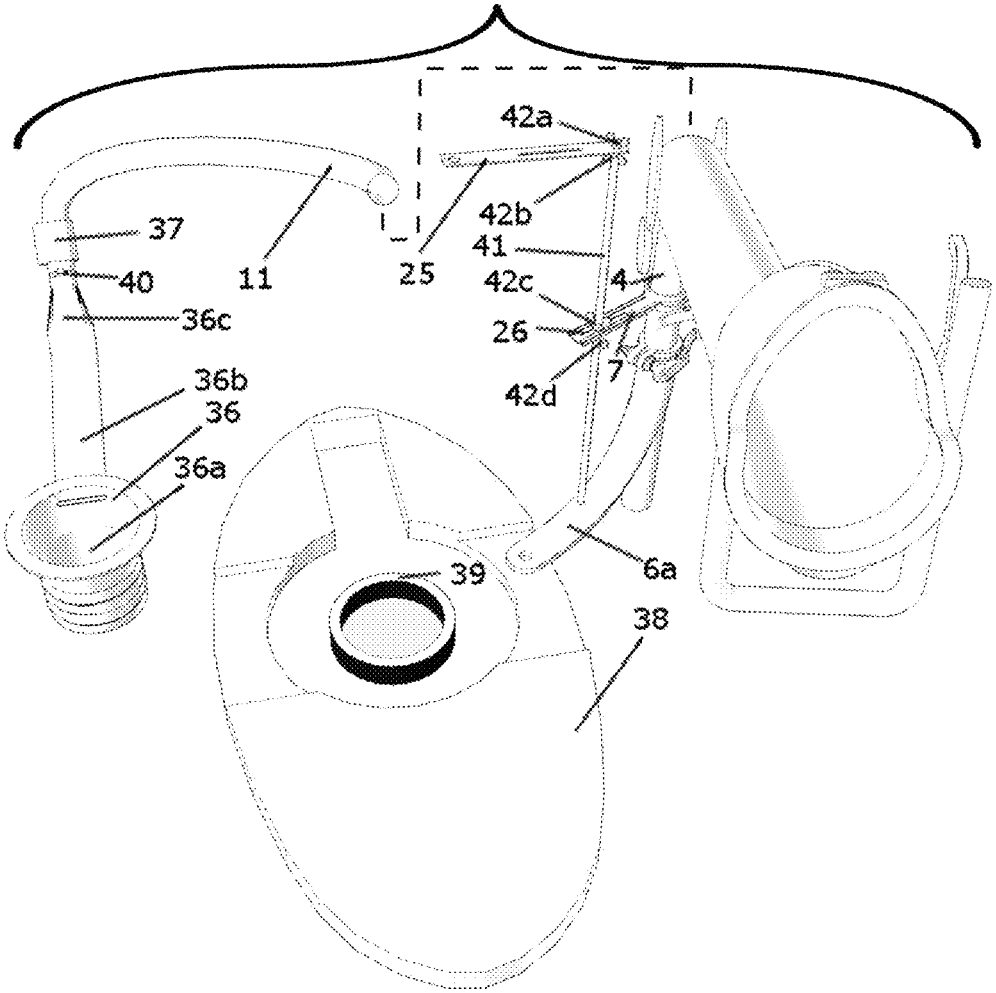
FIG. 17 is a front perspective view of the embodiment of FIG. 15 (toilet is not shown); a waste tube is separated and moved to the left to view the toilet-base.
Figure 18:
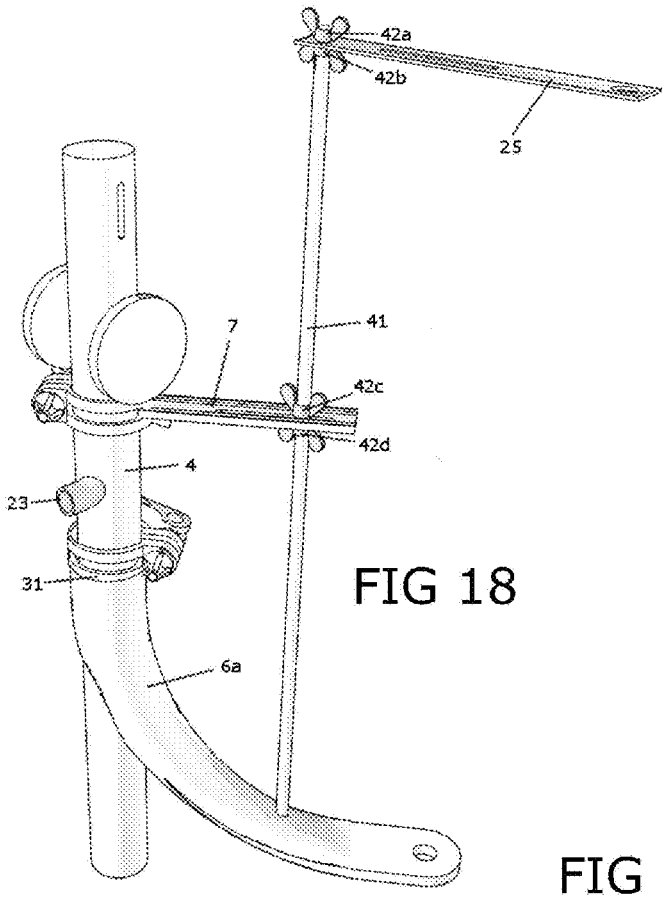
FIG. 18 is a rear perspective view of a leg and foot of the embodiment of FIG. 14.

FIGS. 16-18—Second Embodiment

The installation of the second embodiment is exactly the same as the first. The operation is similar with these few exceptions: When an operator pulls the arm 3 down by the handle 18 from the first position to the second, the arm 3 directly turns the valve stem 20 with an axle 21 on the opposite side to provide balance and support. The arm 3 is then either held in place or dropped to the minimal height as determined by the arm extrusion 3*a*. To return the urinal to the first position, the operator lifts the arm 3 by the handle 18 and pushes the arm 3 back into place.

Detailed Description

FIGS. 16-18—Third Embodiment

FIGS. 16 and 17 show a rear-right and front-top perspective view, respectively, of a third embodiment of the urinal in order to demonstrate an alternate method of waste disposal. Instead of the waste tube 11 leading into the toilet bowl 12 as shown in the first and second embodiments, the waste tube 11 leads to a unique 3-way toilet seal 36. This 3-way toilet seal 36 is much like a conventional rubber/plastic toilet seal 36*a* that connects a toilet sewer line 39 and the sewage outlet of the toilet 1, except that a flat tube 36*b* protrudes from one side of the toilet seal 36*a*. The flat tube 36*b* extends horizontally, turns upward, and alters in shape to become a cylindrical tube 36*c*, which receives a 1-way backflow valve 37 with a ring clamp 40 to fasten the connection.

To allow the 3-way toilet seal 36 to extend out the rear of the toilet 1 so that the toilet 1 does not sit on the flat tube 36*b*, a toilet base 38 is placed under the toilet leaving a gap in the back for the flat tube 36*b* to escape. The base 38 is also used as a mount for the foot 6*a*.

As the embodiment demonstrates in FIGS. 16 and 17, and exclusively in FIG. 18, the support-arm 7 clamps to the leg 4, the extender-bar 25 bolts to the toilet seat bolt 9, and a rod 41 enters the elongated hole 24 of the support arm 7 and a hole in the extender-bar 25. Wing nuts 42*a* and 42*b* fasten the rod 41 to the support arm 7 and wing nuts 42*c* and 42*d* fasten the rod 41 to the extender-bar 25. The bottom end of the rod 41 joins the foot 6*a*.

Operation

FIGS. 16-18—Third Embodiment

This third embodiment of the adjustable, attachable urinal was also designed to be installed on a variety of conventional toilets 1, on either side. Installation is as follows (refer to FIGS. 16-18): if the toilet 1 is already installed, the toilet 1 must be removed from its location above the toilet sewer-line 39. The installer centers the toilet-base 38 on the sewer-line 39. The installer then pastes the 3-way toilet seal 36*a* under the toilet on the sewage outlet with the flat tube 36*b* running toward the rear of the toilet 1. The toilet 1 is then placed over the toilet base 38, fitting the 3-way toilet seal 36*a* into the toilet sewer-line 39. The 1-way backflow valve 37 is then inserted in the cylindrical end of the 3-way toilet seal 36*c* and the clamp 40 is tightened around the connection. The extender-bar 25 is then placed on the toilet seat bolt 9 in the same manner described as in the first embodiment. The foot is then placed on a bolt (not shown) on the toilet base 38, the position of the urinal is then decided on by its allowable rotation, and both bolts (seat bolt 9 and toilet base 38 bolt) are tightened, as well as the wing nuts 42*a* and 42*b* on the rod 41. The installer determines the leg's 4 height and the foot's 6*a* clamp 31 is tightened. The installer determines the height for the support-arm 7 so as not to conflict with any other parts. The installer then tightens the clamp 24 of the support-arm 7, and tightens the wing nuts 42*c* and 42*d* on the rod 41 to the support-arm 7.

This third embodiment is placed between the first and second positions and operates mechanically in exactly the same way as described in the first embodiment. However, instead of the water flowing through the waste tube 11 to the rectangular waste tube 11*a*, 11*b*, and 11*c* and into the toilet bowl 12, the water flows through the waste tube 11 to the backflow valve 37, and into the 3-way toilet seal 36. The purpose of the backflow valve 37 is to block noxious odors from escaping or inhibiting potential backflow from the sewer line.

Alternative Embodiments

FIGS. 7, 10, 11, 19-22

Figure 7:
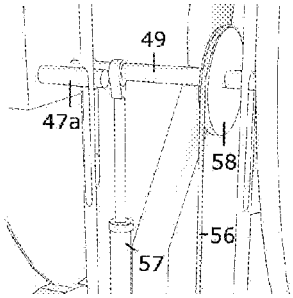
FIG. 7 is a rear perspective view of an alternate design of FIG. 6 with a section-cut of the leg to reveal an alternate design of attaching the wire to the axle of the arm.

There are various alternative designs to portions of the different embodiments:

As shown in FIG. 7, the first embodiment can be slightly altered by mounting and wrapping the wire 56 around a disc 58, which is joined to the axle 49. As the arm 3 is turned downward, the axle 49 and disc 58 rotate, the wire 56 is pulled further, extending the spring 55 further. When the latch 52 is released and the spring 55 actuates, the wire 56 turns and pulls down the disc 58, thus turning and pulling down the axle 49 and attached arm 3, thus returning the arm 3 back to the first position.

FIGS. 10 and 11 show two different alternate designs of the foot 6*a* of the first and second embodiments. FIG. 10 shows a right perspective view of a foot 6*b* with a horizontal bar 34 along the bottom. FIG. 11 shows a rear perspective view of a foot 6*c* with a bar 35 on the bottom to be wedged under the toilet 1 (FIG. 1).

Figure 19:
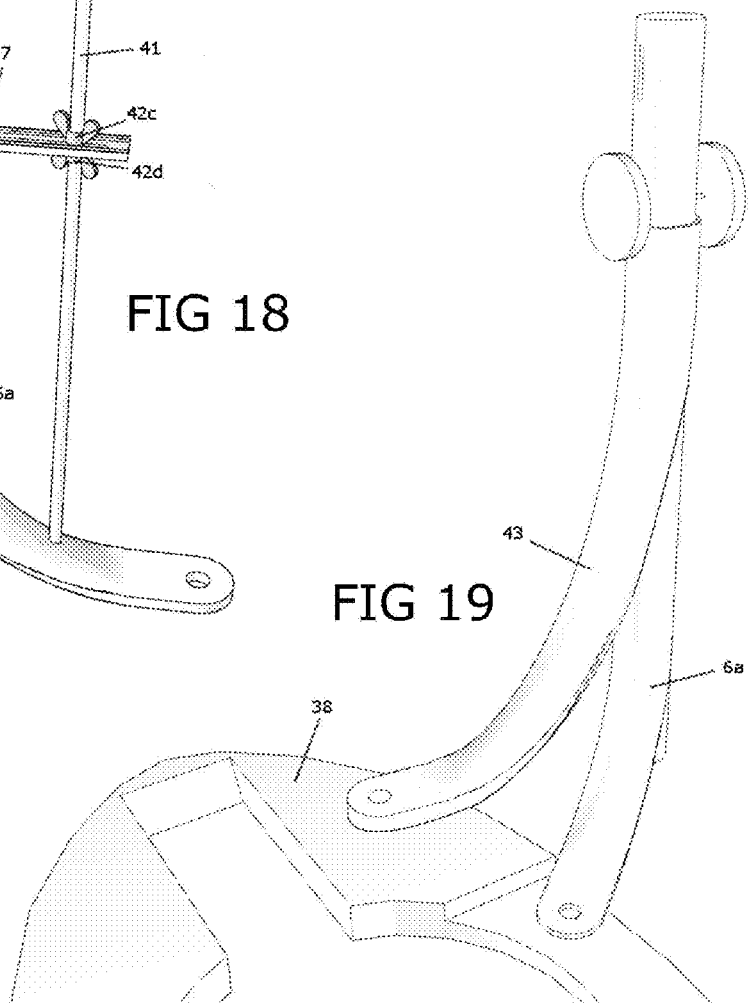
FIG. 19 is a front-left perspective view of an alternate foot design to FIG. 16, which attaches to the toilet base.

FIG. 19 shows a front-left perspective view of an alternate design for the leg 4, as demonstrated in FIGS. 16-18 of the third embodiment. This design shows two feet 6*a* and 43 mounted to the toilet base 38. The second foot 42 is curved differently than the first foot 6*a* so that the top end reaches higher on the leg 4. This second foot 42 is intended to provide support and thus eliminates the support-arm 7, extender-bar 25, and rod 41.

Figure 20:
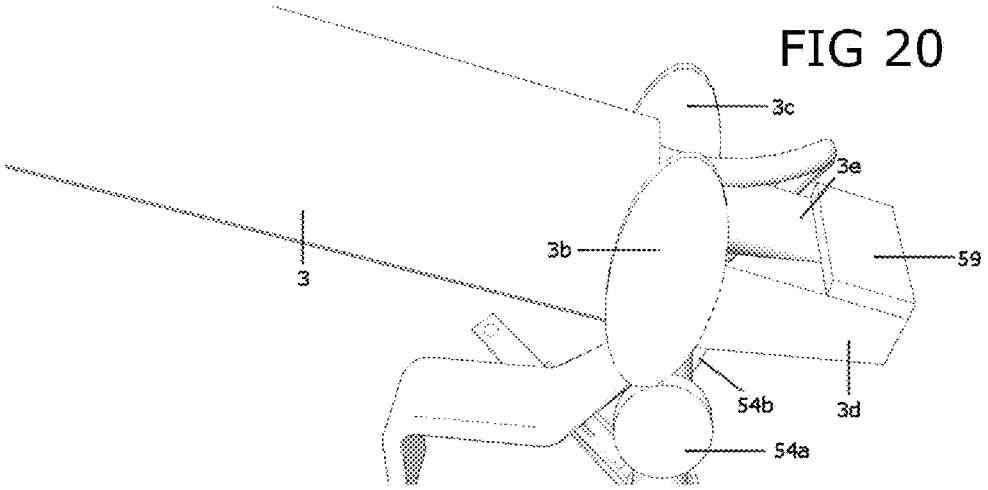
FIG. 20 is a right perspective view of a slightly altered embodiment of FIG. 1 to show the bottom half of the arm with a counterweight.

FIG. 20 shows a right perspective view of a slight alteration to the first and third embodiments in which a weight 59 is added to the elliptical ends 3*b* and 3*c* of the arm 3 by extensions 3*d* and 3*e*. This provides a counterweight to the arm 3 and makes the return from the second position to the first easier. The extensions 3*d* and 3*e* are joined to the exterior surface of the ellipses 3*b* and 3*c* so that when the arm is in its first position and the weight 59 is down, the extensions 3*d* and 3*e* go over the wheels 54*a* and 54*b* and do not obstruct contact between the wheels 54*a* and 54*b* and the ellipses 3*b* and 3*c*.

Figure 21:
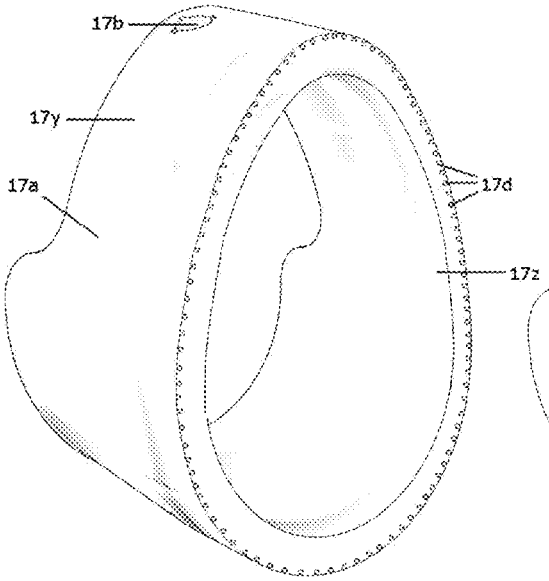
FIG. 21 is a right-rear perspective view of an embodiment of an alternate rim.
Figure 22:
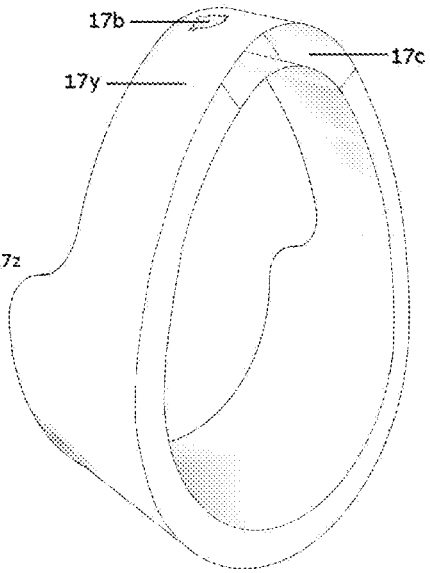
FIG. 22 is a right-rear perspective view of a cross-section of the embodiment of the rim of FIG. 21.

FIGS. 21 and 22 show a rear-left perspective view of a rim 17*a*, which is a slightly altered design of the rim 17 of all three embodiments. FIG. 21 shows the rim 17*a* in its entirety and FIG. 22 is a cross-section view of the front half of the rim 17*a*. The rim 17*a* contains two reservoirs 17*y* and 17*z*. A water-inlet tube 15 (FIG. 4) is affixed to a hole 17*b* of the first reservoir 17*y*. The reservoir 17*y* has only one outlet, a hole 17*c* (FIG. 20), which leads to the second reservoir 17*z*. FIG. 19 shows the outlet of the second reservoir 17*z*, which consists of little holes 17*d* along the edge of the rim 17*a*.

As the urinal is in the second position, the first reservoir 17*y* fills with water from the water-inlet tube 15. If the water level reaches the hole 17*c*, the water spills into the second reservoir 17*z* and trickles through the lower little holes 17*d*. When the urinal is returned to the first position, the water empties out of the first reservoir 17*y* into the second 17*z*, and disperses out of the little holes 17*d* to rinse the interior surface of the receptacle 2.

CONCLUSIONS, RAMIFICATIONS, AND SCOPE

The reader will see that each embodiment described above achieves the main goals of the invention, that is, to provide a urinal that is structurally rigid, self-cleaning, attachable to most conventional toilets without attaching the urinal to the surrounding floor or walls (which would require serious carpentry work), adjustable to the users' preference or space limitations, unobtrusive in non-operative mode, and user-friendly. The urinal is user-friendly in the sense that it is easy to switch between non-operative and operative mode, and can be held in place hands-free during use.

The reader will also see that each embodiment also has its own advantages and disadvantages. While the first and second embodiments are easier to install, the third allows the height of the receptacle to be lowered further to allow usage by shorter adults or children. The first embodiment requires little labor to return the urinal to the first position and is easy for multiple users to set the receptacle at different preferred heights. The second embodiment's simple design has fewer parts, which would mean that the production and manufacture is less expensive and potential mechanical problems would arise less often. Unless the user decides to flush the toilet after using the first or second embodiment, these two embodiments consume less water than using the toilet alone. The third embodiment, in bypassing the toilet, makes flushing completely unnecessary and guarantees water-saving. Unless the leg 4 pokes through the hole 33 of the foot 6*a* all the way down to the floor of any of the three embodiments, or the feet 6*b* or 6*c* of FIGS. 10 and 11 are used, sweeping or mopping the floor under these embodiments is not very difficult.

As for the embodiments' materials, most parts can be made of a stain-resistant plastic, using the plastic molding injection process. It is recommended that parts undergoing stress or friction, such as the axles 20, 21, 20*a*, 21*a*, 49, parts of the spring return mechanism, valves 19, 19*a*, support arm 7, or extender-bar 25, be made of metallic materials with high oxidation-resistance, such as aluminum, brass, or stainless-steel.

While my above descriptions contain many specifics, they should not be construed as limitations on the scope, but rather as an exemplification of several embodiments thereof. Many other variations are possible. For example, instead of the third embodiment having the same spring-release mechanism described in the first embodiment, an alternative design can eliminate this mechanism and incorporate the second embodiment's simplified form. Another variation can switch out the foot, leg, support-arm, extender-bar and rod design featured in FIG. 18 for the foot, leg, support-arm, and extender bar design of the first and second embodiments. Only in this variation, the receptacle will be limited to the same minimal height as the first and second embodiments since the point of pivot 5 cannot exceed below the toilet bowl rim 13.

Additionally, many parts of these embodiments can be slightly altered or substituted with other parts that perform the same function. For example, the handle 18 can be altered to include a grip to the left and/or top of the receptacle 2. The lever-tightening clamps 24 and 31 can be regular nut and bolt ring-clamps. The leg 4 can be separated and mounted together loosely just below the valve to allow the top portion to pivot horizontally slightly when the arm 3 is in the second position. The pneumatic tube 57 may be a hydraulic tube.

The valves 19 and 19*a* can be any turn-based valve; a compression-valve, ball valve, cartridge valve, etc. An alternative to the turn-based valve is one actuated by the pulling or pushing of a rod such as an equilibrium valve. This type of valve can be placed in the same position in the first and third embodiments with the end of the valve stem loosely mounted to the axle 49. The valve can be placed in the second embodiment and designed so that the valve stem is loosely mounted to the arm 3 and is opened and closed by the movement of the arm 3. Furthermore, the valve stem can be loosely mounted to a peg near the circumference of a disc (similar to the one in FIG. 7) on an axle that is a combination of the axles 20 and 21.

A valve in addition to, or in replacement of, the valves 19, 19*a* can be placed around the receptacle 2 or arm 3 to allow greater control of water flow during operation and/or anywhere along the water-inlet tube 22 for a pre-determined water flow.

The valve of any of the embodiments can be also altered to be timer-based, either mechanical or electrical. The return of the arm 3 to the first position would cause the beginning of the count-down of the valve's opening. Using the rim 17*a* of FIG. 21, the water would disperse evenly down the waste-tube 11 in the first position until the end of the timer, at which point the valve closes.

For the embodiments in which the extender-bar 25 is mounted to the toilet-seat bolt 9, a thick nylon washer can be placed on the other seat bolt to balance the toilet seat. In cases where there is not enough room to run the rectangular waste tube 11*c* between the toilet bowl rim 13 and toilet seat 14, one or two more washers can be placed on both seat bolts to raise the seat just enough to slip the tube 11*c* through without the toilet seat 14 sitting on and pinching the tube 11.

FIG. 8 shows how a nut 29 is tightened to hold the waste tube 11 in place during installation. Alternatively, another nut and bolt (not affixed to anything) can be used to hold together the support-arm 7 and extender-bar 25, allowing the bolt 28 affixed to the waste tube 11 to be bolted to either the support-arm 7 or the extender-bar 25, depending on the shape of the toilet bowl rim. FIG. 8 also shows how the extender-bar 25 can slide into the support-arm 7. However, the support-arm 7 can alternatively be bar-shaped, like the extender-bar 25, so that the two can form an angle and so the different embodiments of the urinal can be placed further behind the toilet 1 during installation.

For the embodiments that incorporate the elliptical wheels 3*b* and 3*c* and their complementary circular wheels 54*a* and 54*b*, these wheels can have a surface material that increases the wheels' friction, or they can be redesigned as complementary gears in order to ensure that the turning of the elliptical wheels turn the circular wheels, which ensures that the valve 19*a* opens and closes correctly. Also, these wheels can be dissected so that the only part of the circumference that remains is the part that touches the other wheel and the area that keeps the structural integrity between the circumference and the part joined to the arm 3 (ellipse) or axles 20*a* and 21*a* (circle).

For the second embodiment, it is not easy for multiple users to drop the receptacle to different preferred heights. This inconvenience can be resolved by having the arm extrusion 3*a* adjustable lengthwise using a sliding bar in order to reset the minimal angle incline of the arm 3, and therefore the minimal drop-down height of the receptacle 2.

As an alternative to the spring-return mechanism of the first and third embodiments, a motor can be included in the second embodiment, either placed at the point of pivot 5 to directly turn the axle 20, 21, or arm 3, or placed elsewhere and using an intermediary, such as a belt or chain, to turn the axle 20, 21, or arm 3.

Another alternative to the spring-return mechanism is to incorporate into the second embodiment a torsion spring, one end joined to the leg, the other to the arm, at the point of pivot 5 to return the arm 3 from the second position to the first. Furthermore, a ratchet wheel, pawl, latch, wire, and lever of the first embodiment can be included in this alteration in order to prevent the arm 3 from returning prematurely and to determine the angle of the arm 3 and ultimate height of the receptacle.

To simplify the spring-return mechanism of the first and third embodiments, the ratchet wheel 47 and pawl 48 can be removed, and the latch 52 can be spring-hinged at the top of the leg 4. The latch 52 can be placed to catch the axle 49 of the arm 3 when the arm 3 is turned to the second position and the axle 49 concurrently rises. Pulling the lever 44 and wire 45 turns the latch 52 and releases the axle 49, thus allowing the spring to pull the axle 49 down and return the arm 3.

Likewise, the latch 52 can be moved or duplicated to be spring-hinged just under the hole 50*a* to catch the axle 49 as it is in its lowest position, when the arm 3 is in its first position. This will prevent the arm 3 from falling undesirably. For release, a lever can be attached to the handle under the receptacle 2, with a complementary wire and wire-sleeve leading to the new latch.

The third embodiment features a 1-way backflow valve 37 as a method of blocking noxious odors of the sewer-line or inhibiting backflow. As an alternative, a P water-trap can be placed between the waste-tube 11 and 3-way toilet seal 36, or somewhere along the waste tube 11 in order to block the noxious odors. The only outlet for backflow would be the receptacle 2, which is far above the rim of the toilet in the first position, and therefore unlikely any backflow would discharge from the urinal.

FIGS. 10 and 11 show alternative feet for the first and second embodiments. If necessary, the feet can be further secured by adding another bar, like the arm support 7. One side of the bar clamps low on the foot 6*b* or 6*c* and the bar's opposite side is bolted down by the closet bolt 8.

The design of the counterweight of FIG. 20 can be incorporated into the second embodiment.

The alternative rim 17*a* featured in FIGS. 21 and 22 can be further altered to include the handle 18 (hollowed out) as part of the first reservoir 17*y*.

The previous description and figures demonstrate embodiments that are designed to attach to the conventional toilet 1. However, the toilet itself can be redesigned to accept and secure the different embodiments. A hole or holder can be placed beside the toilet seat bolts 9 (on either side) or lower beside the toilet bowl 12 to receive the leg 4 of the different embodiments. The hole can lead into the top of the toilet bowl 12 so that the waste-tube 11 leads through the leg 4 and directly into the toilet bowl 12. The toilet can also be redesigned to have a second, smaller water-trap running beside the current one, the inlet designed to be somewhere accessible for receiving the waste-tube 11 such as the rear or on the toilet rim 13 in the area by the toilet seat bolts 9, thus making the 3-way toilet seal 36 and toilet base 38 unnecessary in order to bypass the toilet bowl 12.

Accordingly, the scope of the invention should be determined not by the embodiments illustrated, but by the appended claims and their legal equivalents.

I claim:

1. A urinal that attaches to either side of a wide variety of contemporary toilets, comprising of:

a. a receptacle having a funnel-like shape; a large opening on one end, a small opening on the opposite end,
b. an arm that is inflexible, mounted by said receptacle,
c. a leg that is inflexible,
d. a means for mounting said arm to said leg and allowing the arm to pivot between a non-operational, upright position and an operational, near-horizontal position not to exceed below a 5 degree incline on said leg,
e. a foot, designed to receive said leg,
f. a means for securing said leg to any foot to a fastened object in the immediate vicinity of the toilet, including the toilet itself,
g. a means for adjustably securing said leg to said foot, adjustment affecting the height of the junction of said leg and said arm,
h. a waste tube that connects to said receptacle's small end,
i. a means for expelling liquid waste and water from the waste tube into a pre-existing waste-receiver,
j. a valve,
k. a means for connecting the pre-existing water-inlet of the toilet to said valve,
l. a water-outlet tube that connects from said valve to the receptacle,
m. and a means for dispersing water from said water-outlet tube to the interior surface of the receptacle, whereby the urinal can set unobtrusively in a non-operational position, set securely in an operational position, alter the overall height of the receptacle in the operational position without affecting its incline, channel waste and water to pre-existing drains, and use water to rinse waste from the waste-line.

2. The urinal of claim 1, wherein said valve is affected by the pivot of said arm; closing when the arm pivots to its non-operational, upright position and opening when the arm pivots to its operational position.

3. The urinal of claim 1, further including a means for lowering and releasing said arm at incremental angles.

4. The urinal of claim 1, further including a. a spring mounted to said leg,
b. a means for the spring to cause the arm to pivot upward in the spring's kinetic state,
c. a lever,
d. a means for mounting said lever to the urinal,
e. an obstruction that would prevent the spring from returning to its kinetic state when the arm is pulled down to its operational position,
f. and a means for circumventing said obstruction by moving said lever.

5. The urinal of claim 4, further including a means for lowering and releasing said arm at incremental heights.

6. The urinal of claim 5, wherein said means for lowering and releasing said arm at incremental heights is influenced by said obstruction and said spring.

7. The urinal of claim 1, wherein said means for expelling waste is guided into the toilet bowl.

8. The urinal of claim 1, wherein said means for securing said foot is comprised of a means for fastening said leg to a pre-existing closet bolt and a means for fastening the foot to the toilet seat bolt.

9. The urinal of claim 1, wherein said means for expelling waste is guided to a pre-existing sewer line.

10. The urinal of claim 9, further including a base to be placed between the floor and the toilet, whereby providing access to the sewer line for said means for expelling waste.

11. The urinal of claim 10, further including a means for fastening said leg to said base.

12. The urinal of claim 1, further including a rim to be joined at the large end of the receptacle, whereby blocking water or waste from splashing out of said receptacle.

13. The urinal of claim 12, wherein said means for water dispersion comprises of water sprayers located inside the rim and aimed toward the small end of the receptacle.

14. The urinal of claim 12, wherein said means for water dispersion comprises of said rim being designed to receive, retain, and spread water along the interior surface of the receptacle.

15. The urinal of claim 1, further including a means for cushioning said arm when returning to its upright position, whereby preventing the urinal from damage, the urinal from shifting out of place, or water from splashing out of the receptacle.

* * * * *